US012768101B2

(12) United States Patent
Vaz Teixeira et al.

(10) Patent No.: US 12,768,101 B2
(45) Date of Patent: Oct. 20, 2026

(54) CUT RESISTANT JACKET

(71) Applicant: Lankhorst Euronete Portugal, S.A., Maia (PT)

(72) Inventors: Jacinto Daniel Vaz Teixeira, Oliveira do Douro-Cinfães (PT); José Antonio Canedo Duarte Rocha, São Félix da Marinha (PT); Leandro Francisco Haach, Matosinhos (PT)

(73) Assignee: Lankhorst Euronete Portugal, S.A., Maia (PT)

( * ) Notice: Subject to any disclaimer, the term of this patent is extended or adjusted under 35 U.S.C. 154(b) by 323 days.

(21) Appl. No.: 18/685,632

(22) PCT Filed: Sep. 14, 2022

(86) PCT No.: PCT/EP2022/075524
§ 371 (c)(1),
(2) Date: Feb. 22, 2024

(87) PCT Pub. No.: WO2023/041580
PCT Pub. Date: Mar. 23, 2023

(65) Prior Publication Data

US 2024/0352669 A1 Oct. 24, 2024

(30) Foreign Application Priority Data

Sep. 14, 2021 (PT) ..... 20211000034892
Sep. 15, 2021 (EP) ..... 21196955

(51) Int. Cl.
*D07B 1/02* (2006.01)
*D04C 1/06* (2006.01)
(Continued)

(52) U.S. Cl.
CPC ..... *D07B 1/02* (2013.01); *D07B 2201/1014* (2015.07); *D07B 2201/1016* (2013.01);
(Continued)

(58) Field of Classification Search
CPC ..... D07B 1/02; D07B 2201/1014; D07B 2201/1016; D07B 2201/1096;
(Continued)

(56) References Cited

U.S. PATENT DOCUMENTS

2005/0204909 A1 9/2005 Morissette
2011/0111200 A1* 5/2011 Schneiders ..... D07B 1/025 87/8
(Continued)

FOREIGN PATENT DOCUMENTS

CN 105316967 2/2016
EP 3392404 10/2018
(Continued)

OTHER PUBLICATIONS

International Search Report and Written Opinion for PCT/EP2022/075524 dated Dec. 23, 2022.

*Primary Examiner* — Harry Y Oh
(74) *Attorney, Agent, or Firm* — BakerHostetler

(57) ABSTRACT

The invention is directed to a jacketed mooring rope (1) comprising a core rope (2) and a jacket (3) surrounding said core rope, wherein the jacket comprises a braided layer of level 2 braided strands (30) and wherein said level 2 braided strands each comprise a plurality of level 1 braided strands (40). In another aspect, the invention is directed to a rope (30) for use in the jacket (3) of the jacketed mooring rope (1), wherein said rope (30) comprises a plurality of level 1 braided strands (40) that each comprise a plurality of braided yarns (50) surrounding one or more core yarns (51), wherein the braided yarns and the core yarns comprise fibers having a yarn count of at least 440 den; a tenacity of at least 5 g/den; and/or a modulus of at least 100 g/den.

20 Claims, 5 Drawing Sheets

(51) Int. Cl.
*D04C 1/12* (2006.01)
*D07B 1/20* (2006.01)

(52) U.S. Cl.
CPC ..... *D07B 2201/1096* (2013.01); *D07B 2201/2003* (2013.01); *D07B 2201/2023* (2013.01); *D07B 2201/2039* (2013.01); *D07B 2201/209* (2013.01); *D07B 2205/2039* (2013.01); *D07B 2501/2061* (2013.01)

(58) Field of Classification Search
CPC .... D07B 2201/2003; D07B 2201/2023; D07B 2201/2039; D07B 2201/209; D07B 2205/2039; D07B 2501/2061; D07B 1/20; D07B 2205/201; D07B 2205/2014; D07B 2205/2042; D07B 2205/2046; D07B 2205/205; D07B 2501/2007; D07B 2501/2015; D07B 1/025; D07B 2401/2075; D04C 1/06; D04C 1/12
See application file for complete search history.

(56) References Cited

U.S. PATENT DOCUMENTS

| | | | | |
|---|---|---|---|---|
| 2013/0247534 | A1* | 9/2013 | Canedo Duarte Da Rocha | D07B 5/00 57/220 |
| 2014/0090549 | A1* | 4/2014 | Hurlen | D04C 3/00 87/9 |
| 2015/0152595 | A1* | 6/2015 | Van Wunnik | D07B 1/04 87/6 |

FOREIGN PATENT DOCUMENTS

| | | | |
|---|---|---|---|
| EP | 3143196 | B1 | 2/2021 |
| KR | 200475026 | | 11/2014 |
| WO | 03/054291 | A1 | 7/2003 |
| WO | 2012134301 | | 10/2012 |
| WO | 2013/148711 | A1 | 10/2013 |

* cited by examiner

Comparison between CR-Tape and LankoShield

CUT RESISTANT JACKET

The invention is directed to mooring ropes. In particular, the invention is directed to jackets for mooring ropes to protect the mooring ropes.

Mooring ropes (e.g. tug ropes, hawsers, tethers and anchoring ropes) are commonly employed in deep-water long-term mooring systems. The ropes are conventionally manufactured with polyester in the cores and in the jacket, which is a consolidated technology around the world. The polyester cores fulfill the physical and mechanical requirements (tenacity, elongation, stiffness, and fatigue, for instance) and the function of the polyester cover is to join the sub-ropes and to protect them against abrasion during rope handling and installation. However, in terms of cut resistance, the conventional polyester jackets do not have a good performance. In various offshore experiences, after installation, the polyester mooring lines were easily cut by wire ropes.

In the art, various jackets are known that aim to protect mooring ropes against abrasion and the like. Examples include the jacket of Calora Mooring Systems AS, who developed a rope protection solution under the brand name Calorfloat® technology of which the rope's core is basically covered by helically wound polymeric tapes that form the jacket. Other examples are provided in KR 2004/475026 and WO 2012/134301. In EP3143196 and WO 2013/148711, cut-resistant jackets based on metal are described. A drawback of using metal is its high density, its high weight to strength ratio and its tendency to corrode, in particular in off-shore applications.

Another jacket for mooring ropes is known from WO 03/054291, wherein the OTS Protective Jacket™ of Offshore & Trawl Supply (OTS) is described. A drawback of the OTS Protective Jacket™ is that two braided layers are necessary to provide sufficiently protection, demanding two synchronized braiding machines working together or two consecutive braiding operations to cover the rope core.

It is an object of the present invention to provide a mooring rope that is cut resistant and that addresses at least one or more of the above-mentioned drawbacks.

The present inventors surprisingly found that this object can be met by a jacket that comprises a braided layer of jacket ropes (herein also referred to as level 2 braided strands) which each comprise a braided plurality of small ropes (herein also referred to as level 1 braided strands). Preferably, the level 1 and/or level 2 strands are flat braided strands.

Flat strands and flat ropes refer to strands and ropes respectively, having an essentially non-circular cross-sectional shape, as illustrated in FIGS. 2B and 3A.

Accordingly, the present invention is directed to a jacketed mooring rope comprising a core rope and a jacket surrounding said core rope, wherein the jacket comprises a braided layer of level 2 braided strands which each comprise a braided plurality of level 1 braided strands. In other words, the level 1 braided strands represent a lower hierarchy level than the level 2 braided strands.

Figure 1A:
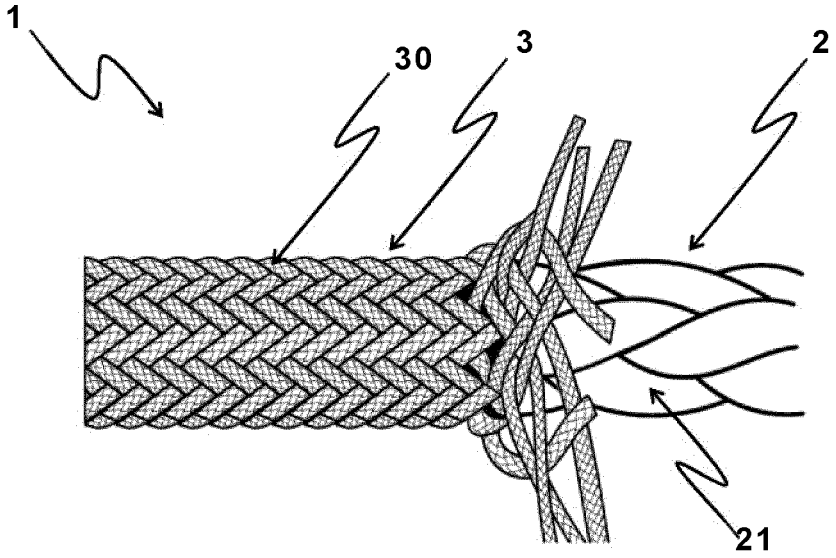
FIG. 1A illustrates a preferred embodiment of the jacketed mooring rope according to the invention.

In a preferred embodiment, the level 1 braided strands comprise a braided plurality of yarns (50) surrounding one or more core yarns (51). As such, and in particular by using one or more core yarns, a flat small rope, i.e. a flat level 1 braided strand, can be obtained, which is preferred for the construction of the jacket rope, which is preferably also a flat rope. Accordingly, the level 1 braided strand is preferably a level 1 flat braided strand. Similarly, the level 2 braided strand is preferably a level 2 flat braided strand. The level 1 braided strand may each comprise at least 3, preferably 4 to 12, more preferably 6 to 8 braided yarns surrounding one or more core yarns. And typically, the level 1 braided strand comprise two or more, preferably two core yarns.

The dimension of the level 1 braided strand are preferably such that they can be used to construct a small-dimensioned jacket, while not jeopardizing their main purpose: the protection of the core rope. As such, in preferred embodiments, the level 1 braided strand and preferably the braided yarns and the core yarns thereof, comprise fibers, preferably high performance fibers, having a yarn count of at least 440 den, preferably at least 1400 den, such as at least 1600 den; a tenacity of at least 5 g/den, more preferably at least 15 g/den, such as at least 20 g/den, most preferably at least 30 g/den; and/or a modulus of at least 100 g/den, preferably at least 1000 g/den, more preferably at least 1300 g/den. In a most preferred embodiment, the level 1 braided strands and preferably the braided yarns and the core yarns thereof consist essentially of the high performance fibers. Fibers may be based on polyethylene terephthalate (PET) or the like, which may optionally be blended with high performance fibers. High performance fibers are well known in the art and may for example be based on aramid, high-modulus polyethylene (HMPE), ultra-high-molecular-weight polyethylene (UHMWPE) or liquid crystal polymer (LCP) or combinations thereof. Fibers and yarns that are suitable for the present invention are for example those commercially available under the tradename Dyneema™.

Particular good results were obtained with a braided jacket based on level 1 braided strands, having a circular cross-section with a diameter of less than 5 mm, preferably between 1 and 4 mm, more preferably between 2 and 3 mm such as about 2.3 mm. In the embodiment wherein the level 1 braided strand are flat ropes, i.e. level 1 flat braided strands, these ropes preferably have a smallest diameter of less than 3 mm, preferably between 1 and 2 mm such as about 1.7 mm. With smallest diameter is herein meant the shortest diameter of the inscribed circle in the cross-section of the rope.

The level 1 braided strands are re-braided to form the level 2 braided strands, which in turn are braided to form the jacket. Typically, each level 2 braided strand comprises between 3 and 64 level 1 braided strands. The number of level 1 braided strands can appropriately be selected based on the desired thickness of the jacket ropes (i.e. the level 2 braided strands) and the jacket. Generally, the jacket ropes are hollow braid and do not comprise a core.

In a preferred embodiment, the level 2 braided strands, preferably the level 2 flat braided strands, have a thickness or smallest diameter of less than 15 mm, preferably between 4 and 10 mm, more preferably between 6 and 8 mm such as about 7 mm.

As the level 2 braided strands are based on level 1 braided strands, it may be appreciated that all the strands preferably comprise the fibers described above. In preferred embodiments, the level 2 braided strands consist essentially of the level 1 braided strands and therefore, in a most preferred embodiment, the level 2 braided strand consist essentially of said high performance fibers. In particular, the jackets and thus the level 2 braided strands as well, are preferably free of metal wires or other forms of metal. Advantageously, the construction of the jacket according to the present invention provides good cut resistance without the necessity to use metal reinforcements. As such, the jacket and/or the jacketed mooring rope can have a density of less than 1 g/cm$^3$, which allows it to float on water. This is particular beneficial for off-shore applications.

Moreover, the jacket can be provided by a single braided layer of the level 2 braided strands. Good cut resistance, as well as good abrasion resistance, can thus already be achieved with a single braided layer of the level 2 braided strand.

The core rope of the jacketed mooring rope is typically based on polyester. However, the jacket according to the present invention can in principle protect any type of rope and material. Exemplary core ropes can thus be based on polyester, polyethylene, high modulus polyethylene, polypropylene, aramids, liquid crystal polymers and/or polyamide. Given its particular suitability in mooring ropes, the core rope is preferably based on polyester. The core rope can for example be a 3-strand laid rope or a 12-strand or an 8-strand braided polyester rope.

A further aspect of the present invention is directed to the jacket rope, i.e. the level 2 braided strand as such. Preferably, the level 2 braided strand is a level 2 flat braided strand. These level 2 braided strands can be advantageously used for protection of mooring ropes, but also for other types of ropes such a hoisting ropes, mining ropes and other ropes that are exposed to abrasion and sharp environments.

The inventions can be described and illustrated by the following non-limiting figures.

Figure 1B:
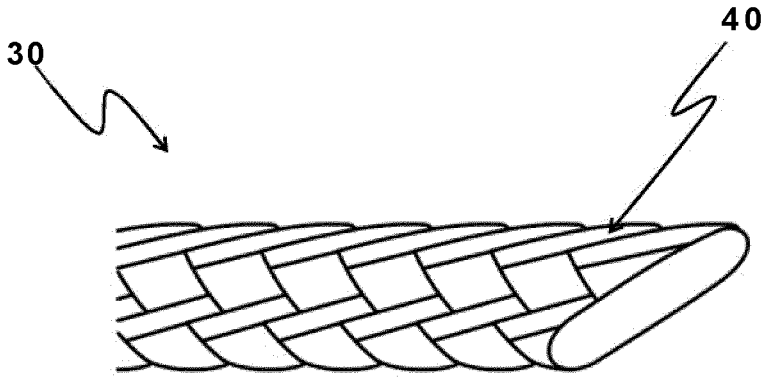
FIG. 1B illustrates a preferred embodiment of the level 2 braided strands according to the invention.

In FIG. 1A, a preferred embodiment of the jacketed mooring rope (1) comprising a core rope (2) and a jacket (3) is illustrated. The jacket surrounds the core rope by its braided construction comprising level 2 braided strands (30). Each level 2 braided strand comprises a braided plurality of level 1 braided strands (40), as is better visible in FIG. 1B, which provides an isolated illustration of a part of a level 2 flat braided strand.

Figure 2A:
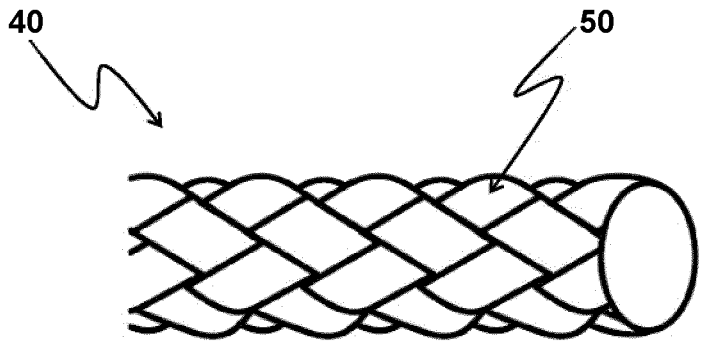
FIGS. 2A-2C illustrate preferred embodiments of the level braided strands according to the invention.
Figure 2B:
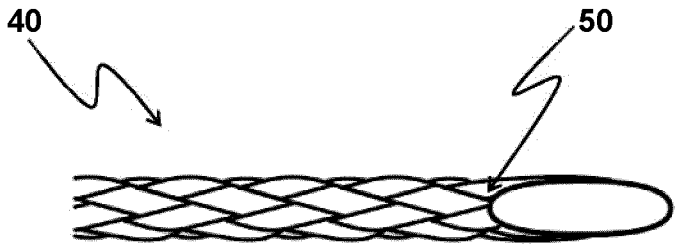
Figure 2C:
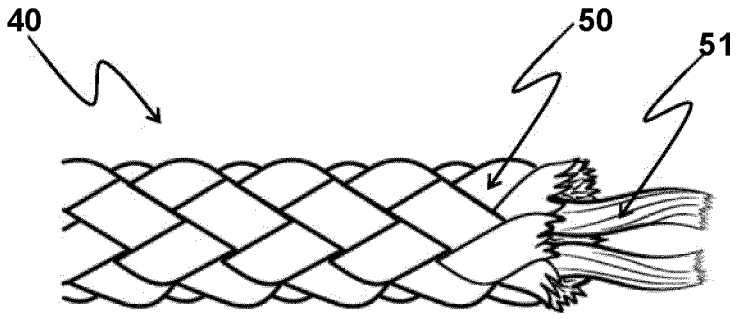

FIGS. 2A-2C provide isolated illustrations of embodiments of a level 1 braided strand. The level 1 braided strand illustrated herein comprise a braided layer of yarns (50). The level 1 braided strand may also be flat (FIG. 2B) or its cross-section may be substantially circular (FIG. 2A). In a preferred embodiment as illustrated in FIG. 2C, the level 1 braided strand comprises a braided plurality of yarns (50) surrounding two core yarns (51).

Figure 3A:
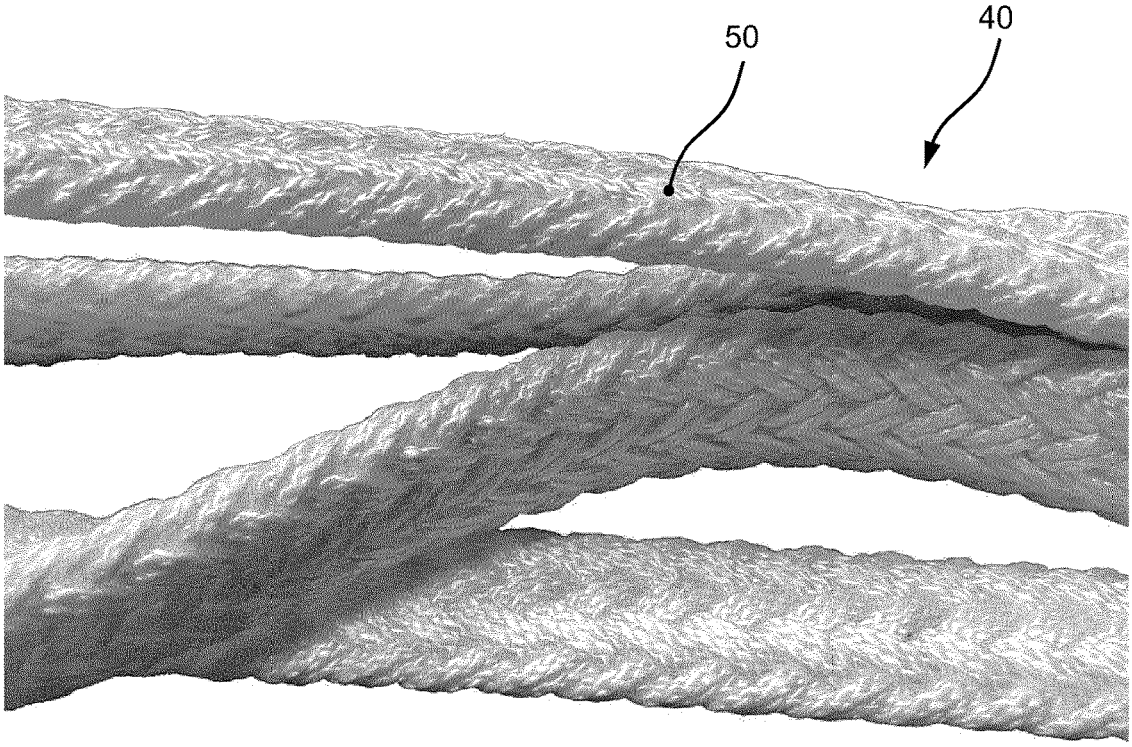
FIG. 3A is a photographic image of a preferred jacket rope according to the invention.
Figure 3B:
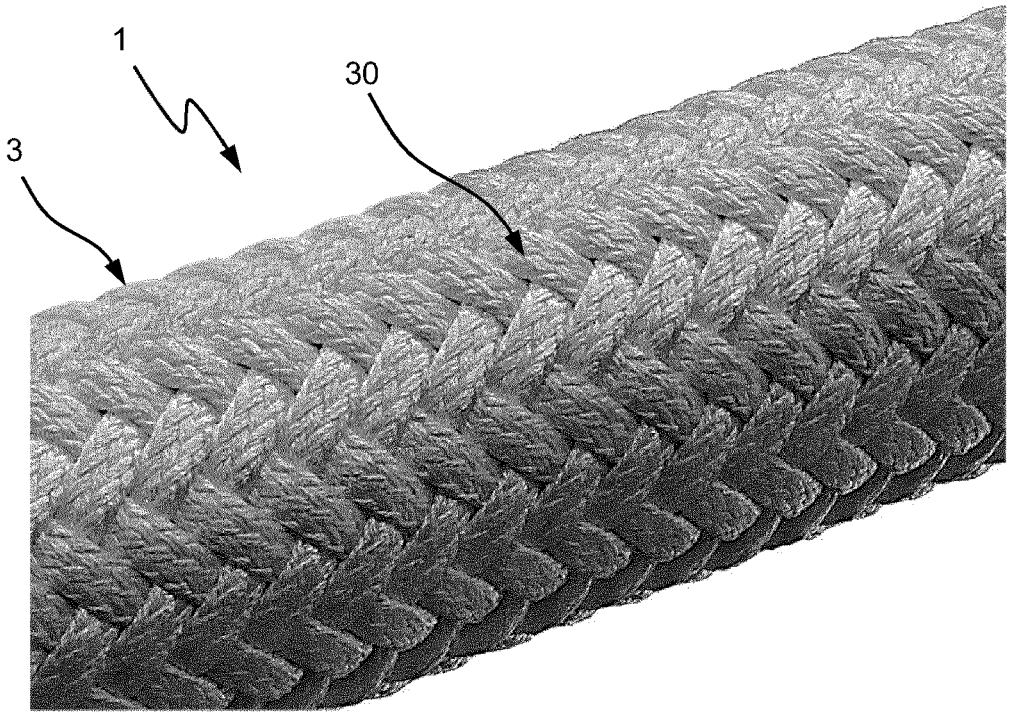
FIG. 3B is a photographic image of a preferred jacketed mooring rope according to the invention.

Photographic images of a jacket rope and a jacketed mooring rope according to preferred embodiments of the present invention are provided in FIGS. 3A and 3B, respectively.

As used herein, the singular forms "a", "an" and "the" are intended to include the plural forms as well, unless the context clearly indicates otherwise. The term "and/or" includes any and all combinations of one or more of the associated listed items. It will be understood that the terms "comprises" and/or "comprising" specify the presence of stated features but do not preclude the presence or addition of one or more other features.

For the purpose of clarity and a concise description features are described herein as part of the same or separate embodiments, however, it will be appreciated that the scope of the invention may include embodiments having combinations of all or some of the features described.

The invention can further be illustrated by the following non-limiting examples.

EXAMPLE 1

Rope Construction

A jacketed rope as shown in FIG. 3B was prepared. A polyester core rope was provided with a diameter of 114 mm. The jacket was based on level 2 flat braided strands as shown in FIG. 3A, which were each based on level 1 flat braided strands made of a braided layer of Dyneema™ 1600D yarns surrounding two core yarns of Dyneema™ 1600D. The level 2 flat braided strands had an average thickness of 5.5 mm, the jacket had a thickness of about 11 mm and the final jacketed mooring rope had a diameter of 136.3 mm.

Cut Resistance Testing

Figure 4A:
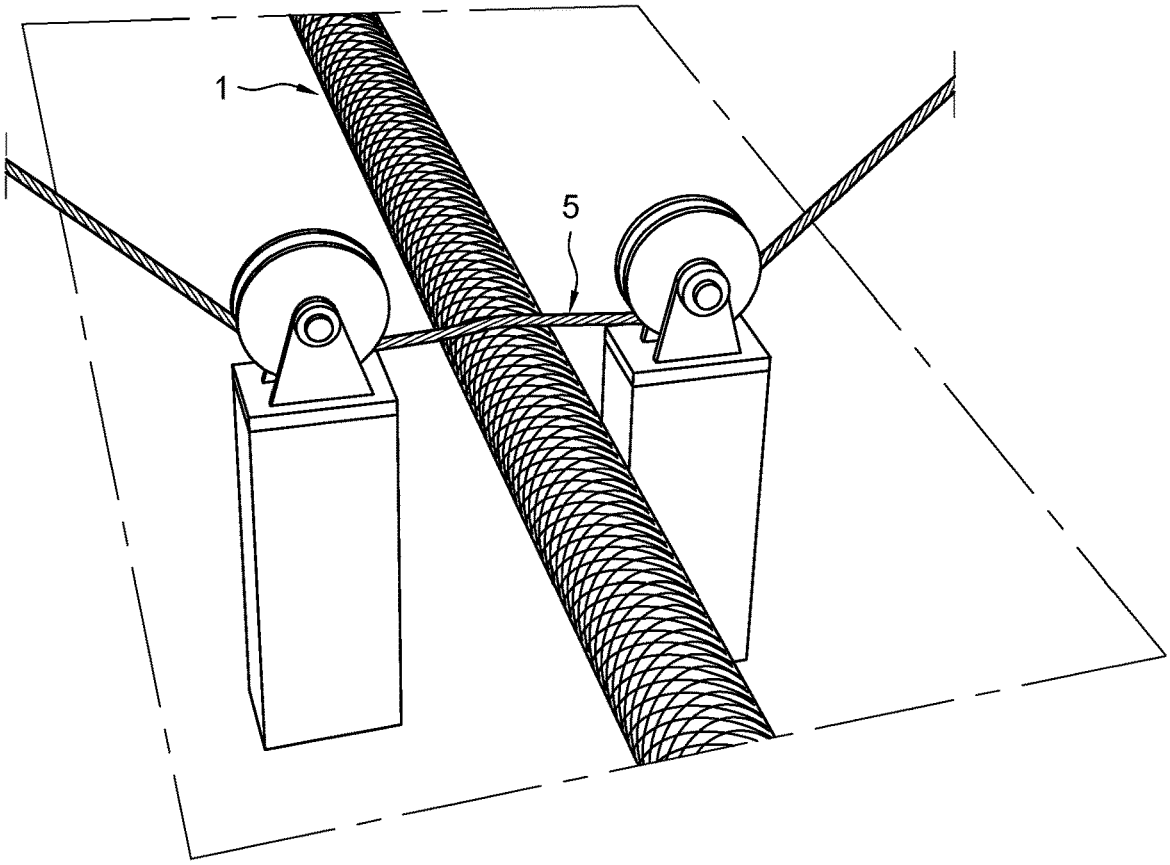
FIGS. 4A-4B are photographic images of a particular testing setup to quantitatively test the cut resistance of ropes.
Figure 4B:
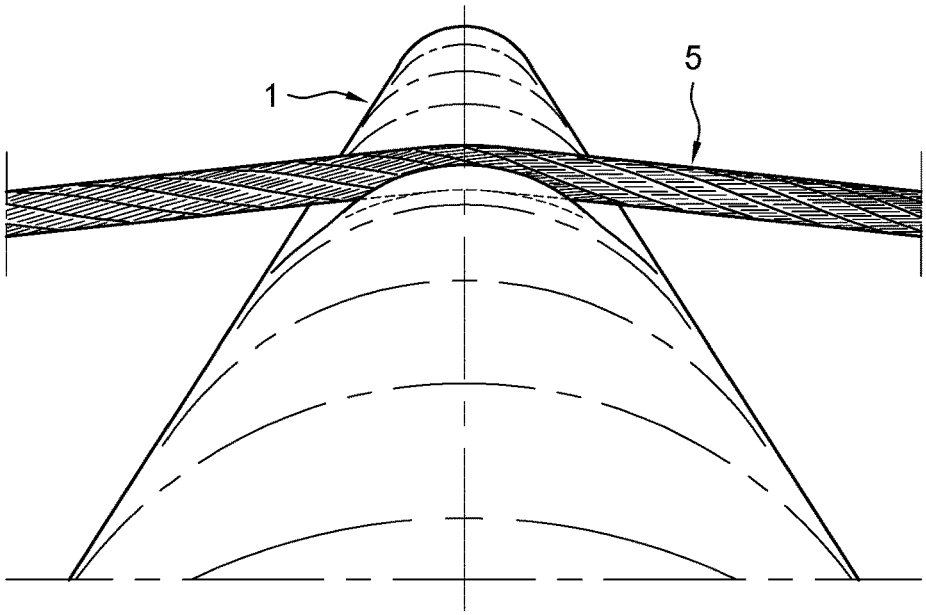

A cut resistance testing setup was designed to simulate and reproduce in a laboratory the effect of trawler wires coming into contact with synthetic fiber mooring ropes lines, quantifying the damage and assessing the ropes residual strength after the event. This allowed a comparative study between the state of the art cut resistant tape and ropes according to the present invention. The developed test rig is shown in FIGS. 4A and 4B. In the testing setup, a steel wire ropes (SWR, 5) is moved over a jacketed rope (1) under set test parameters. The test parameter were set as given in Table 1.

TABLE 1

| Cutting test machine features | | |
|---|---|---|
| Diameter - SWR | Mm | 16 |
| Tension - SWR (Tw) | kN | 29 |
| Linear velocity - SWR (U) | Knots | 0.3 |
| Direction of movement - SWR | | Reciprocating back and forth |
| Displacement - SWR | m | 9 per cycle |

Results

Figure 5:
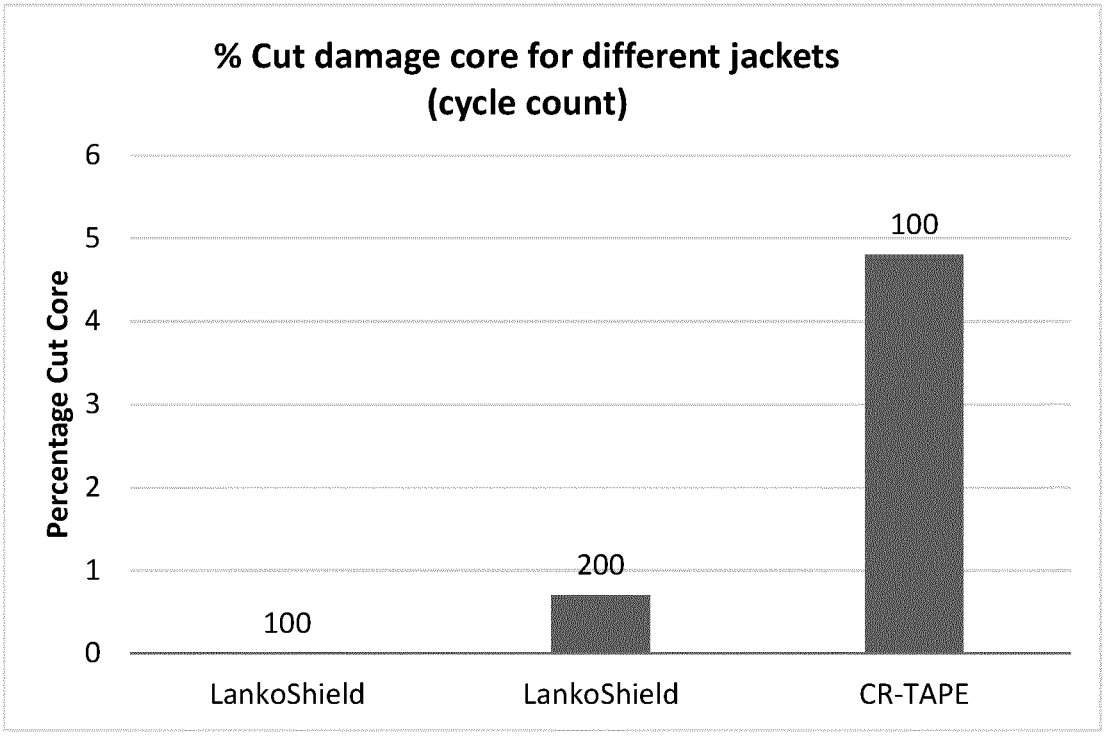
FIG. 5 illustrates the results of a comparative test using a rope according to the present invention and a mooring rope comprising a double layered OTS Protective Jacket™ (CR-tape).

The rope as described above (referred to as Lanko® Shield) was tested and compared with a mooring rope comprising a double layered OTS Protective Jacket™ (CR-tape). The results are provided in Table 2 and FIG. 5.

TABLE 2

| Jacket | Rope Ø (mm) | Jacket thickness (mm) | Number of cycles | Cut core (%) |
|---|---|---|---|---|
| OTS Protective Jacket ™ (double layer) | 141.7 | 13.2 | 100 | 4.8 |
| Lanko ®Shield | 136.3 | 11 | 100 | 0.0 |
| Lanko ®Shield | 136.3 | 11 | 200 | 0.8 |

The invention claimed is:

1. A jacketed mooring rope comprising a core rope and a jacket surrounding said core rope, wherein the jacket comprises a braided layer of level 2 braided strands and wherein said level 2 braided strands each comprise a braided plurality of level 1 braided strands, wherein the level 1 braided strands are level 1 flat braided strands.

2. The jacketed mooring rope according to claim 1, wherein the level 1 braided strands each comprise a braided plurality of yarns surrounding one or more core yarns.

3. The jacketed mooring rope according to claim 1, wherein the level 1 braided strands each comprise at least 3 braided yarns surrounding one or more core yarns.

4. The jacketed mooring rope according to claim 2, wherein the level 1 braided strands each comprise two or more core yarns.

5. The jacketed mooring rope according to claim 1, wherein the level 1 braided strands have a diameter of less than 5 mm.

6. The jacketed mooring rope according to claim 1, wherein the level 1 flat braided strands have a smallest diameter of less than 3 mm.

7. The jacketed mooring rope according to claim 1, wherein each level 2 braided strand comprises 3 to 64 level 1 braided strands.

8. The jacketed mooring rope according to claim 1, wherein the level 2 braided strands are level 2 flat braided strands having a thickness of less than 15 mm.

9. The jacketed mooring rope according to claim 1, wherein the core rope comprises polyester strands that are braided together.

10. The jacketed mooring rope according to claim 1, wherein the level 2 braided strands and the level 1 braided strands comprise fibers having a yarn count of at least 440 den; a tenacity of at least 5 g/den; and/or a modulus of at least 100 g/den.

11. The jacketed mooring rope according to claim 1, wherein the jacket is free of a metal wire.

12. The jacketed mooring rope according to claim 1, wherein the jacket is a single braided layer of the level 2 braided strands.

13. The jacketed mooring rope according to claim 1, wherein the jacket and/or the jacketed mooring rope has a density of less than 1 g/cm$^3$.

14. The jacketed mooring rope according to claim 1, wherein the core rope comprises the braided plurality of level 1 braided strands that each comprise a braided plurality of yarns surrounding one or more core yarns and wherein the braided plurality of yarns and the core yarns comprise fibers having a yarn count of at least 440 den; a tenacity of at least 5 g/den; and/or a modulus of at least 100 g/den.

15. The jacketed mooring rope according to claim 14, wherein the jacketed mooring rope is comprised in a jacket of a jacketed rope to provide cut-resistance to the jacketed rope.

16. The jacketed mooring rope according to claim 2, wherein the level 1 braided strands each comprise two core yarns.

17. The jacketed mooring rope according to claim 1, wherein the level 1 braided strands have a diameter of between 1 and 4 mm.

18. The jacketed mooring rope according to claim 1, wherein the level 1 braided strands are level 1 flat braided strands having a smallest diameter of between 1 and 2 mm.

19. The jacketed mooring rope according to claim 1, wherein the level 2 braided strands are level 2 flat braided strands having a thickness of between 4 and 10 mm.

20. The jacketed mooring rope according to claim 14, wherein the braided plurality of level 1 braided strands each comprise a braided plurality of yarns surrounding two core yarns.

* * * * *